US011572738B2

(12) United States Patent
Espinoza et al.

(10) Patent No.: US 11,572,738 B2
(45) Date of Patent: Feb. 7, 2023

(54) TUNABLE WELLBORE PULSATION VALVE AND METHODS OF USE TO ELIMINATE OR SUBSTANTIALLY REDUCE WELLBORE WALL FRICTION FOR INCREASING DRILLING RATE-OF-PROGRESS (ROP)

(71) Applicant: WILDCAT OIL TOOLS, LLC, Midland, TX (US)

(72) Inventors: Jaime Espinoza, Gilmer, TX (US); Mark F. Alley, The Woodlands, TX (US); Antonio Garza, Tomball, TX (US)

( * ) Notice: Subject to any disclaimer, the term of this patent is extended or adjusted under 35 U.S.C. 154(b) by 0 days.

(21) Appl. No.: 16/722,848

(22) Filed: Dec. 20, 2019

(65) Prior Publication Data

US 2022/0034165 A1 Feb. 3, 2022

(51) Int. Cl.

| | |
|---|---|
| ***E21B 4/02*** | (2006.01) |
| ***E21B 7/24*** | (2006.01) |
| ***E21B 21/10*** | (2006.01) |
| ***E21B 28/00*** | (2006.01) |
| ***E21B 7/06*** | (2006.01) |

(52) U.S. Cl.

CPC ..... *E21B 4/02* (2013.01); *E21B 7/065* (2013.01); *E21B 7/24* (2013.01); *E21B 21/10* (2013.01); *E21B 28/00* (2013.01)

(58) Field of Classification Search

CPC ... E21B 4/02; E21B 7/065; E21B 7/24; E21B 21/10; E21B 28/00

See application file for complete search history.

(56) References Cited

U.S. PATENT DOCUMENTS

| | | | | |
|---|---|---|---|---|
| 2,780,438 | A | 2/1957 | Bielstein | |
| 6,237,701 | B1 | 5/2001 | Kolle et al. | |
| 6,279,670 | B1 * | 8/2001 | Eddison | E21B 4/02 175/107 |
| 9,279,300 | B2 | 3/2016 | Kolle et al. | |
| 9,637,976 | B2 | 5/2017 | Lorenson et al. | |
| 2006/0272821 | A1 * | 12/2006 | Webb | E21B 7/18 166/305.1 |
| 2007/0187112 | A1 * | 8/2007 | Eddison | E21B 31/005 166/380 |
| 2008/0029268 | A1 * | 2/2008 | Macfarlane | E21B 10/60 166/311 |

(Continued)

*Primary Examiner* — Robert E Fuller
*Assistant Examiner* — Neel Girish Patel
(74) *Attorney, Agent, or Firm* — Hulsey P.C.

(57) ABSTRACT

A tunable wellbore pulsation valve reduces drillstring friction in a wellbore. An upper valve plate and a lower valve plate, and upper valve plate orifice and lower valve plate orifice enabling throughflow. A Moineau motor rotates the upper valve plate while the lower valve plate remains stationary. Fluid flow causes a first fluid state of fluid passing through both the upper valve plate and the lower valve plate when the fluid passing causes rotation of the upper valve plate to align the upper valve plate orifice with the lower valve plate orifice. Increased flow efficiency produces more powerful fluid pressure pulsations and axial vibrations without increasing pump pressure at the surface of the wellbore, yielding increased wellbore friction reduction while expending the same or less energy at the surface pump than would be expended in the absence of the reduced turbulent and shear conditions and increased laminar conditions.

18 Claims, 13 Drawing Sheets

(56) References Cited

U.S. PATENT DOCUMENTS

| | | | | |
|---|---|---|---|---|
| 2009/0139769 | A1* | 6/2009 | Traylor | E21B 4/02 175/57 |
| 2010/0243265 | A1* | 9/2010 | Sherrill | E21B 41/0085 166/373 |
| 2012/0186878 | A1* | 7/2012 | Eddison | E21B 4/14 175/57 |
| 2012/0279724 | A1* | 11/2012 | Eddison | E21B 4/18 166/374 |
| 2014/0041943 | A1* | 2/2014 | Lanning | E21B 4/02 175/57 |
| 2019/0100965 | A1 | 4/2019 | Orban et al. | |
| 2019/0153797 | A1* | 5/2019 | von Gynz-Rekowski | E21B 28/00 |

* cited by examiner

TUNABLE WELLBORE PULSATION VALVE AND METHODS OF USE TO ELIMINATE OR SUBSTANTIALLY REDUCE WELLBORE WALL FRICTION FOR INCREASING DRILLING RATE-OF-PROGRESS (ROP)

FIELD OF THE DISCLOSURE

The present disclosure relates to field production equipment for extracting hydrocarbon energy resources from an oilfield and, more particularly, to deep drilling for obtaining oil, gas, water, soluble or meltable materials or a slurry of minerals from wells. Even more particularly, the present disclosure relates to a tunable wellbore pulsation valve and methods of use to eliminate or substantially reduce wellbore wall friction for increasing drilling rate-of-progress (ROP).

BACKGROUND OF THE INVENTION

During the drilling of an oil and gas wellbore, the drillstring, and downhole tools connected to the drillstring, encounter friction against the wellbore wall. The friction inhibits the advancement of the drill bit, also known as "Rate of Progress" (ROP) in the industry. This ROP-limiting friction is encountered in both conventional drilling, with a rotating drill string, and also in drilling methods employed on coiled tubing, with a rotating bit at the distal end of non-rotating tubing. In order to ameliorate this situation, the industry employs a variety of friction reducing tools, sometimes referred to as vibration, oscillation or agitation tools.

All wellbore friction reduction tools seek to advance a drill bit, mill or BHA through a binding wellbore, and often, additionally, through obstructing, impeding matter. This obstruction will often be formation rock, but can also be cement or a device previously placed in the wellbore, such as a frac plug. The rate of progress (ROP) can be greatly slowed or halted during an operation, especially in the case of modern horizontal wells that extend laterally for very long distances, creating great frictional forces. Additionally, drill pipe or coiled tubing can encounter irregular wellbores that are not "straight" holes, but rather bores that deviate considerably from axial concentricity, with such bores spiraling or otherwise straying from a straight course. The force of gravity accentuates frictional issues in a long lateral bore. The industry faces great challenges, and experiences failures, when attempting to advance the drill bit farther and farther into long laterals plagued with somewhat crooked bores and the ever-present gravitational force weighing down the drillstring.

While friction reduction tools attempt to address this problem, they can have varying degrees of success. Some tools do not function well with drilling mud or dirty fluid containing a lot of particulate matter, including sand, debris and bits of formation rock. These tools may rapidly clog. Many tools exhibit wear issues, with erosion destroying internal components and reducing the effectiveness or functionality of the tool. Additionally, the pressure pulse in some tools may create shocks that are so severe that they can damage the tools or adjacent components.

Prior art U.S. Pat. No. 2,780,438 teaches a method of varying fluid flow inside the drill string by utilizing a two-plate valve system. Much like with modern positive displacement mud motors, the U.S. Pat. No. 2,780,438 embodiment includes a helically-vaned member attached to the top valve plate, causing this valve plate to rotate during flow. Each valve plate has orifices, and with the lower, distal plate being stationary, the rotating plate above it causes a variation in flow of drilling fluid. This variation in flow creates fluid pulsations that transmit vibration downward through the drill string to aid in advancement of the drill bit. Similarly, U.S. Pat. No. 6,279,670 describes a method of flow pulsing in a downhole tool also utilizing two valve plates with orifices. The top valve plate rotates during flow due to being connected with a positive displacement motor, the bottom valve plate remaining stationary. Flow through the orifices varies as the top valve plate rotates, and fluid pulses are created as openings through the valve come into alignment. These fluid pulses energize a separate component capable of extending and retracting axially so as to deliver an axial mechanical shock that vibrates the drill string. Variations of this method are still commonly practiced in the industry.

U.S. Pat. No. 9,637,976 shows valve plates, or "flow heads," that contain multiple round-hole ports in multiple sizes. As rotation of the linked rotor rotates the first flow head, a varying, polyrhythmic or arrhythmic fluid pulse pattern is achieved.

U.S. Pat. Nos. 6,237,701 and 9,279,300, both by the same applicant, explain a different method for creating fluid pulses in a wellbore friction reduction tool. A poppet, which contains a pilot valve, moves reciprocally between an open and closed position. In the open position, fluid passes through the throat of the poppet seat, and in the closed position, when the poppet seats, flow is closed. This reciprocal, axial movement generates the fluid pulses due to the poppet's reciprocation causing rapid drops in pressure.

Incorporating some similar concepts as seen in U.S. Pat. No. 6,237,701, published U.S. Patent Application 2019/0100965 A1 utilizes an axially-reciprocating "leaky shuttle valve" to achieve pressure drops and wellbore friction reduction.

Referring again to U.S. Pat. No. 6,279,670, this patent details the principles of a rotor disposed within a stator, operating as a Moineau motor, with this rotor being linked to a valve plate with a flow port. A second valve plate is located immediately below, or downstream from, the upper valve plate. The second valve plate remains stationary while the upper valve plate, being linked to a rotor rotating during fluid flow, rotates. Through-ports exist in both valve plates and are designed so that flow will pass through both valve plates when the ports rotationally pass into alignment. These principles and U.S. Pat. No. 6,279,670 are hereby incorporated by reference.

The tuning of the valves can address specific wellbore conditions, when information on wellbore conditions is known or can be anticipated. For example, some wellbores may be known in advance to have some problem areas, i.e. areas in which the drillstring or BHA may tend to bind and limit, or stop, forward progress. This can be the case when drilling out frac plugs in long lateral sections of a wellbore.

An operator may desire to run a less aggressive, flow smoother pulsing agitation system in such conditions, knowing that a more aggressive pulse may damage mechanical parts and cause a failure, requiring a trip out of the wellbore for repairs. Under better and simpler conditions, in which no substantial wellbore problem areas are anticipated, an operator might desire to run an aggressively pulsing system, possibly with a higher frequency of pulses, in order to maximize ROP. Increasing fluid flow through the tool can increase the pulse frequency. However, limited pumping capacity at the surface can be a practical limitation on altering the downhole function of agitation tools.

In the prior art, many valve plates are formed with orifices comprised of straight, circular bore holes through the plates at 90 degrees in relation to the faces of the plates. When the holes align, a fluid pulse occurs. U.S. Pat. No. 9,637,976 shows a plurality of straight holes rather than a single straight hole, but many tools on the market utilize a single straight hole in each plate.

The industry seeks to produce rapidly rising and high-cresting pulse waves that would deliver greater axial shocks. In challenging, high-friction wellbores, in which it is difficult to advance the drillstring or BHA, stronger shocks created by such strong pulses are desirable and even essential to ROP.

The valve plates in the instant disclosure, combined with a Moineau motor, may be placed anywhere in the drillstring. These valve plates may be used with a shock tool in conventional rotary mud drilling, or without a shock tool in coiled tubing applications, causing an expansion and contraction of the coil itself as pressure pulses spike and drop.

In contrast to orifices comprised of straight, circular holes through valve plates, it is possible, and often desirable, to utilize some different orifice shapes that allow more flow to pass through the orifice in a single pulse during alignment of the plates. Additionally, it can be desirable to maintain some amount of throughflow passing through the plates at all times by placing a portion of a contiguous orifice of some shape in the center of each plate, allowing a constant throughflow of fluid.

BRIEF SUMMARY OF THE DISCLOSURE

The present disclosure provides for improvements in field exploration and production equipment for drilling for obtaining oil, gas, water, soluble or meltable materials or a slurry of minerals from wells, and more specifically to a tunable wellbore pulsation valve and methods of use to eliminate or substantially reduce wellbore wall friction for increasing drilling rate-of-progress (ROP).

According to one aspect of the presently disclosed subject matter, here is provided a tunable wellbore pulsation valve for reducing drillstring friction in a wellbore that includes an upper valve plate and a lower valve plate, with the upper valve plate housing an upper valve plate orifice enabling throughflow and the lower valve plate housing a lower valve plate orifice enabling throughflow. The upper valve plate associated with a Moineau motor and shouldered against a rotor outlet of the Moineau motor, the upper valve plate rotating during fluid rotation of the Moineau motor, while the lower valve plate remains stationary.

Fluid flow through the drillstring causes a first fluid state of fluid passing through both the upper valve plate and the lower valve plate when the fluid passing causes rotation of the upper valve plate to align the upper valve plate orifice with the lower valve plate orifice, and wherein the fluid flow through the drillstring further causes a second fluid state of fluid not passing through both the upper valve plate and the lower valve plate when the fluid-flow causes rotation of the upper valve plate to not align the upper valve plate orifice with the lower valve plate orifice.

The fluid flow rotationally-alternates the first fluid state and the second fluid state producing fluid pressure pulsations for transmitting axial vibration through the drillstring with the effect of reducing friction experienced by the drillstring against the wellbore wall. The top valve plate orifice comprises rounded corners and a straight side, wherein a semicircle overlaps the axial center of the top valve plate and bisects the straight side. The top valve plate orifice comprises a slope running radially outward from a perimeter of the top valve plate orifice at an upper face-plane the top valve plate, the top valve plate orifice beginning at a point radially proximal to the axial center and terminating at a point radially proximal to an outer diameter of a bottom face-plane of the top valve plate.

The top valve plate orifice slope increases fluid flow efficiency as the fluid flows through the top valve plate orifice by reducing turbulent and shear conditions and increasing laminar, outwardly radial fluid flow conditions for the fluid flowing through the tunable wellbore pulsation valve, where the increased flow efficiency produces more powerful fluid pressure pulsations and axial vibrations without increasing pump pressure at the surface of the wellbore, yielding increased wellbore friction reduction while expending the same or less energy at the surface pump than would be expended in the absence of the reduced turbulent and shear conditions and increased laminar conditions.

The instant disclosure optimizes the valve plates themselves, providing approaches for tuning the valves and therefore the individual pulses in order to increase ROP and reduce wear or damage to the tool or adjacent components. With some similarities to the principles of pulse width modulation (PWM) of electrical signals, the division of voltage and current into pulses, the valve plates in the instant disclosure may be tuned. Pressure is at its greatest when rotation has positioned the top valve plate and bottom valve plate such that they do not have their orifices aligned, limiting or stopping throughflow. When the top and bottom valve plate do have their orifices aligned, partially or totally, throughflow is greatly increased and pressure drops. Continually alternating from high to low pressure produces axial shocks that transmit vibration down the drill string, reducing friction in the wellbore. Tuning the valves means altering the valve plates' respective through through orifice shape or profile, or their number, so as to change pulse duration or wavelength, amplitude and frequency.

The tuning of the valves can address specific wellbore conditions, when information on wellbore conditions is known or can be anticipated. For example, some wellbores may be known in advance to have some problem areas, i.e. areas in which the drillstring or BHA may tend to bind and limit, or stop, forward progress. This can be the case when drilling out frac plugs in long lateral sections of a wellbore. An operator may desire to run a less aggressive, flow smoother pulsing agitation system in such conditions, knowing that a more aggressive pulse may damage mechanical parts and cause a failure, requiring a trip out of the wellbore for repairs.

Under better and simpler conditions, in which no substantial wellbore problem areas are anticipated, an operator might desire to run an aggressively pulsing system, possibly with a higher frequency of pulses, in order to maximize ROP. Increasing fluid flow through the tool can increase the pulse frequency. However, limited pumping capacity at the surface can be a practical limitation on altering the downhole function of agitation tools. The valve plates in the instant disclosure, combined with a Moineau motor, may be placed anywhere in the drillstring. These valve plates may be used with a shock tool in conventional rotary mud drilling, or without a shock tool in coiled tubing applications, causing an expansion and contraction of the coil itself as pressure pulses spike and drop.

In the prior art, many valve plates are formed with orifices comprised of straight, circular bore holes through the plates at 90 degrees in relation to the faces of the plates. When the holes align, a fluid pulse occurs. U.S. Pat. No. 9,637,976 shows a plurality of straight holes rather than a single straight hole, but many tools on the market utilize a single straight hole in each plate.

In contrast to orifices comprised of straight, circular holes through valve plates, it is possible, and often desirable, to utilize some different orifice shapes that allow more flow to pass through the orifice in a single pulse during alignment of the plates. Additionally, it can be desirable to maintain some amount of throughflow passing through the plates at all times by placing a portion of a contiguous orifice of some shape in the center of each plate, allowing a constant throughflow of fluid.

The instant disclosure provides valve plates with many varying angled and curved flow paths that can be used to produce different sorts of pulse waves. The waveforms vary significantly based on the shapes of the orifices.

One goal of the disclosed subject matter is to provide, when required, a means of altering the fluid pulse while not altering pump pressure at the surface. In prior art tools, using circular orifices through the valve plates as an example, a pulse wave of modest amplitude was generated, rising symmetrically from the trough of the wave to a low crest and falling back to the trough in a way that mirrored the rise. Axial shocks from such tools were not particularly strong or effective, in most cases, in reducing friction and improving ROP.

The above advantageous features and technical advantages are described below in the technical description of the disclosed subject matters and claimed in the claims asserted thereafter.

BRIEF DESCRIPTION OF THE DRAWINGS

The present subject matter will now be described in detail with reference to the drawings, which are provided as illustrative examples of the subject matter so as to enable those skilled in the art to practice the subject matter.

Notably, the figures and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

Figure 1A:
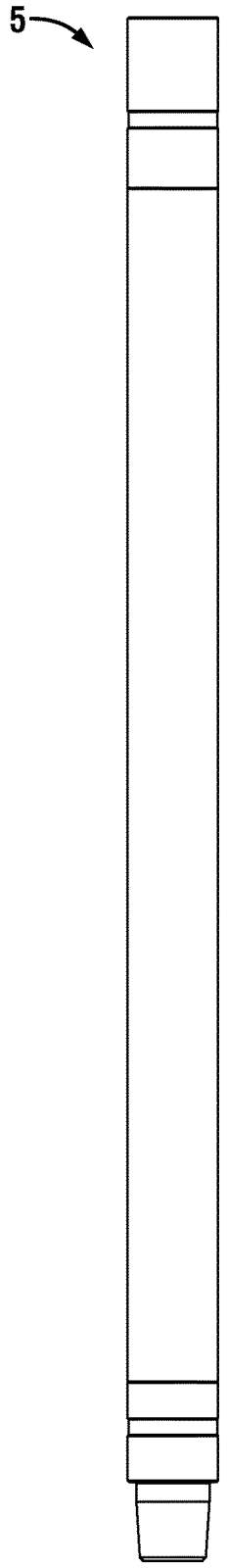
FIG. 1A depicts an isometric view of the assembled friction reducing tool.

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the following description, numerous details are set forth to provide an understanding of the disclosed embodiments. However, it will be understood by those of ordinary skill in the art that the disclosed embodiments may be practiced without these details and that numerous variations or modifications may be possible without departing from the scope of the disclosure.

The disclosed embodiments generally relate to a system and method designed to facilitate sidetracking operations in which at least one lateral/deviated wellbore (i.e., borehole) is formed with respect to another wellbore, e.g., with respect to a vertical wellbore. Certain embodiments disclosed herein relate to The disclosed subject matter places significant slopes and curves in the orifices of the valve plates. Viewing the top valve plate from its top face, i.e. the face of the smaller diameter, uphole portion, an angled or curved orifice is utilized rather than a straight 90-degree orifice. Here, the "far wall" of the orifice in the valve plates means, on a given valve plate face, the orifice wall most radially distant from the axial center of the valve plate, and the "near wall" the most radially proximal from the axial center of the valve plate. The shapes of the orifices in top or bottom valve plates are the same in each embodiment in this disclosure, such that the shapes adjoin symmetrically when the valve plates align, and with the same TFA top to bottom in both the top and the bottom valve plates.

In this disclosure, the preferred embodiment has an orifice slope such that from the top face to the bottom face of a valve plate, the far wall and near wall on each face are in different radial positions in relation to each other and the axial center of the valve plate. An orifice slope of 2-10 degrees is typical in some of the disclosed embodiments. Utilizing an orifice slope, combined with varying shapes of orifices in both plates, reduces turbulence and disruption of the fluid path, increasing throughflow and increasing the amplitude from trough to crest of the pulse wave. In practical terms, when pumping at the same pressure from the surface, i.e. not adjusting the surface pump to increase pressure, the valve plate with a sloped orifice produces a pulse with greater throughflow and in turn a stronger axial shock than unsloped orifices, giving the disclosed valve plates a significant advantage over the prior art.

Aside from shaping the pulse wave, another goal of the subject matter is to vary the shapes and profiles of the valve plate orifices in order to accommodate various specific gravities of fluids that may be flowing through the orifices as well as the rates at which such fluids may be flowing. Certainly larger orifices can accommodate heavier or more viscous fluids. Adapting valve plates to better mesh with fluid flow results in less erosion of components from turbulence.

Additionally, the disclosed subject matter adapts valve plate orifice profiles or shapes to accommodate the helical flow of fluid exiting the Moineau motor. Utilizing the helical flow path to fullest advantage permits more substantial pulses, greater axial shocks, and increased ROP. Adapting valve plates to accept, or mesh with, the helical fluid flow path creates a competitive advantage over prior art valve plates.

FIG. 1A depicts an isometric view of the assembled friction reducing tool 5.

Figure 1B:
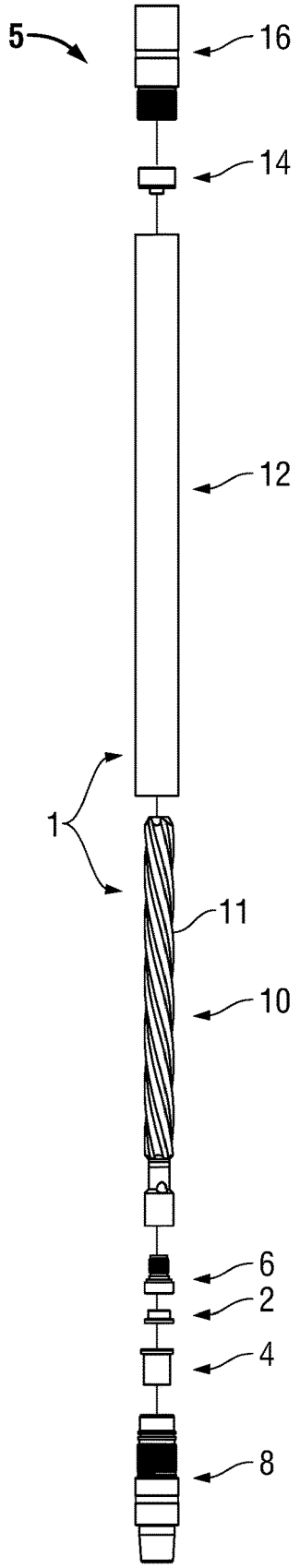
FIG. 1B depicts an exploded view of friction reducing tool, with Moineau motor assembly that with includes a rotor and stator and a rotor outlet 6 adjacent to the top valve plate and bottom valve plate.

FIG. 1B depicts an exploded perspective view of friction reducing tool 5, including a Moineau motor assembly 1 that includes a rotor 10 and stator 12 and a rotor outlet 6 to the top valve plate 2 and bottom valve plate 4. When flow passes—and exits a Moineau motor, this flow is rotating, or swirling helically, in a direction opposite to the direction of rotation of the rotor 10, and in the same direction as the helical slope of the rotor threads 11. In other words, if the rotor 10 is moving in a clockwise motion when viewed from above, i.e. from topside when looking downhole into the wellbore, the fluid moves in a counterclockwise motion. For our purposes, with oil and gas downhole tools or workstrings turning, colloquially, "to the right," i.e. clockwise, the fluid will be swirling helically to the left, or counterclockwise, in opposition to the turning rotor 10. The helical flow of the fluid is steeper, and at a less sharp helix angle, than the helix angle of the rotor threads 11. The fluid exiting the Moineau motor is flowing slightly helically and in a counterclockwise rotation, and passes-a slightly restrictive rotor outlet 6 of a smaller diameter than the stator 12. Both top and bottom valve plates are depicted in FIG. 1B. As the fluid passes—the rotor outlet 6, it enters the top valve plate 2. As top valve plate 2 and bottom valve plate 4 enter into and out of alignment during a rotational period, fluid pulses occur, agitating the drillstring and reducing friction so as to increase ROP. The top and bottom valve plates contain orifices of various forms disclosed herein, with some embodiments of the valve plates designed to accept helical flow, enabling a smoother path through which the fluid may flow, and changing the form of fluid pulse waves.

Figure 2:
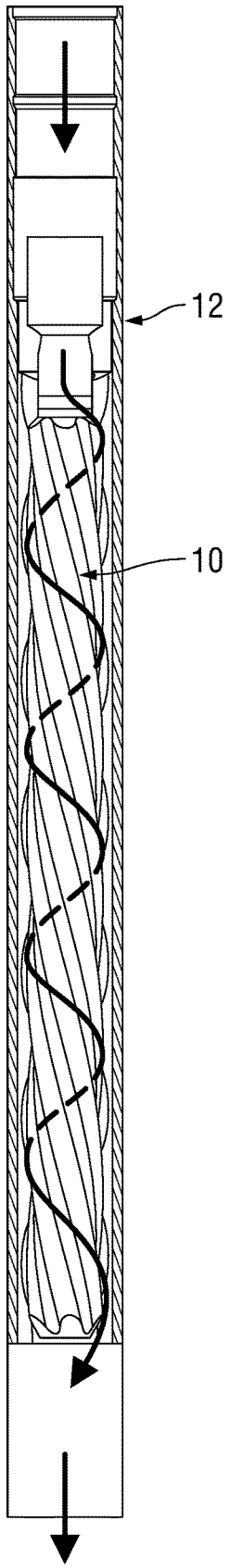
FIG. 2 illustrates the basic concept of fluid flowing helically through a Moineau motor.

FIG. 2 is conceptual in nature, depicting a rotor 10 rotating clockwise within a stator 12, and fluid rotating counterclockwise around the rotor 10, resembling a corkscrew as depicted by the spiraling arrow. The clockwise rotor rotation is depicted by the curved circumferentially oriented, leftward arrow drawn at the bottom of the rotor 10. At the top end of this assembly, an axial arrow indicates flow of fluid entering the assembly. When the fluid reaches the rotor 10 within the stator 12, the rotor rotates clockwise while the fluid rotates in a counterclockwise direction, in opposition to the rotor. Again, the spiraling, corkscrew-styled arrow indicates the counterclockwise flow of fluid, with this helical flow of the fluid being steeper, and at a less sharp helix angle, than the helix angle of the threads of the rotor 10. At the bottom of the rotor 10 and stator 12, an axial arrow indicates fluid exiting the assembly. The fluid exiting the assembly continues to rotate counterclockwise, but this rotation is not shown.

Figure 3A:
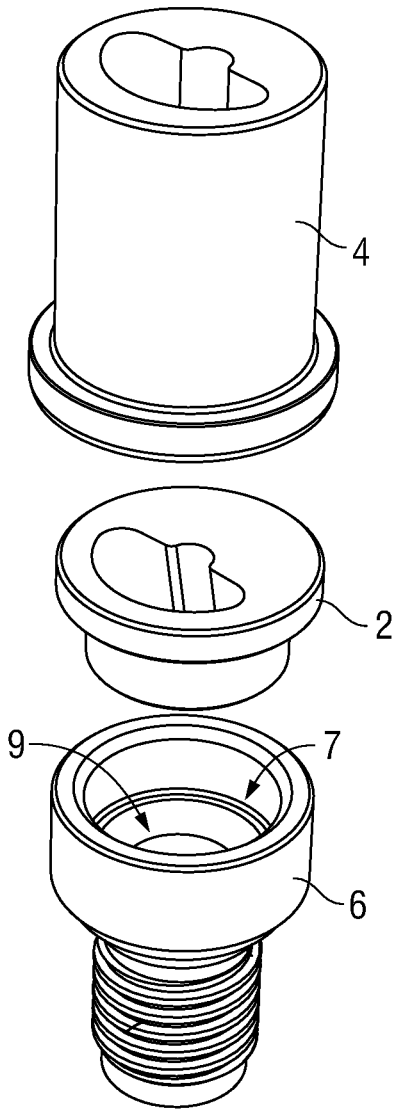
FIGS. 3A and 3B depict a rotor outlet, a top valve plate, and a bottom valve plate, all in exploded, isometric view.
Figure 3B:
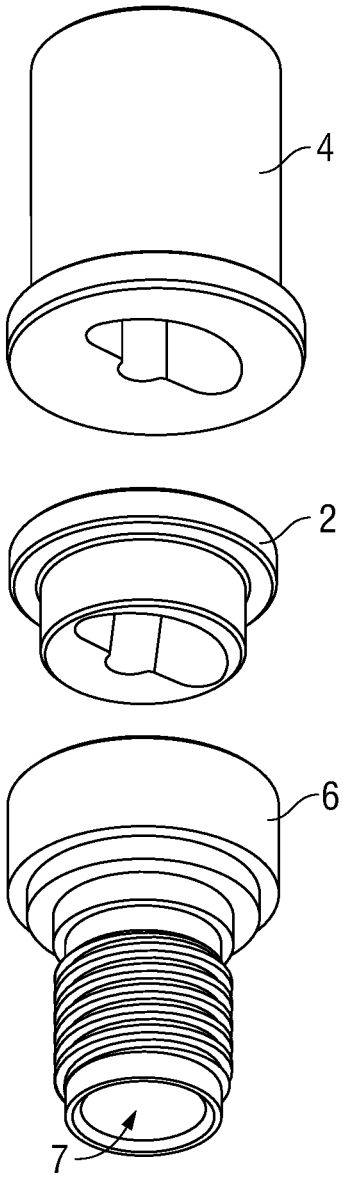

FIG. 3A and FIG. 3B depict a rotor outlet 6, a top valve plate 2, and a bottom valve plate 4 all in exploded, isometric perspective view. The rotor outlet 6, top valve plate 2 and bottom valve plate 4 are seen in FIG. 1B above as well, located adjacent and downhole from the Moineau motor. The rotor outlet 6 is positioned immediately downhole adjacent in relation to the rotor 10 and stator 12, and is threadably attached to the rotor 10 (not shown in FIG. 3A). When fluid exits rotor 10 and stator 12, as seen in FIG. 2, rotating counterclockwise helically, the fluid passes through the rotor outlet 6 positioned adjacent to the top valve plate 2. The rotor outlet 6 has an axial bore 7 with a smaller inside diameter than the stator 12 through most of the rotor outlet's inner axial bore 7, including the portion of the bore proximal to the stator 12. Only the lower portion of the axial bore 7 of the rotor outlet tapers to a larger diameter. The rotating fluid, with its centripetal force, exits the rotor 10 and stator 12 and enters the constrictive rotor outlet 6, where it must first pass through the smaller inside diameter portion of the axial bore 7 in the rotor outlet. At the downhole end of the rotor outlet 6 adjacent to the top valve plate 2, the axial bore 7 in the rotor outlet tapers to a larger inside diameter 9, as seen in FIG. 3A. The fluid exits through the larger inside diameter 9 portion of the rotor outlet 6 and subsequently enters the orifice in the top valve plate 2, with said top valve plate 2 being positioned adjacent to and shouldered against the rotor outlet 6 at rotor outlet's downhole, proximal end. Being shouldered against the rotor outlet 6, the top valve plate 2 rotates clockwise with the rotor outlet 6 while the bottom valve plate 4 remains stationary.

Upon entering the rotor outlet 6, the helically rotating fluid is constrained by the smaller inside diameter portion of the rotor outlet 6. However, when the fluid passes into the tapering-larger inside diameter 9 portion of the rotor outlet 6, its centripetal force causes its counterclockwise helical flow path to expand against the tapering-larger inside diameter 9 wall of the rotor outlet. As the fluid exits the tapering-larger diameter 9 portion of the rotor outlet 6, it first passes through the top valve plate 2 and then the bottom valve plate 4 as shown in FIG. 3B.

First Case: Smooth, Low-Amplitude Pulse

Figure 4A:
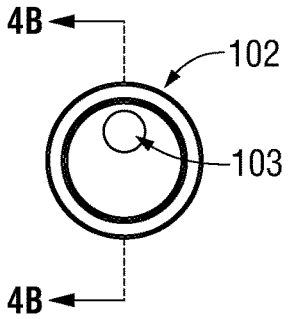
FIGS. 4A, 4B, and 4C and FIGS. 5A, 5B, and 5C depict a prior art valve plate design.
Figure 4B:
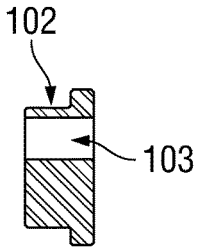
Figure 4C:
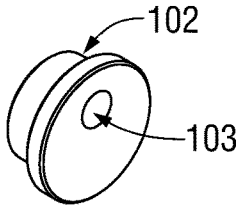
Figure 5A:
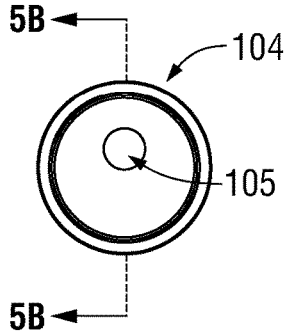
Figure 5B:
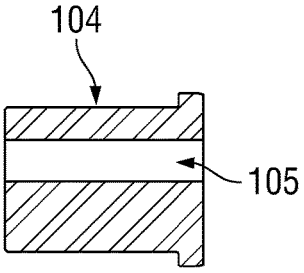
Figure 5C:
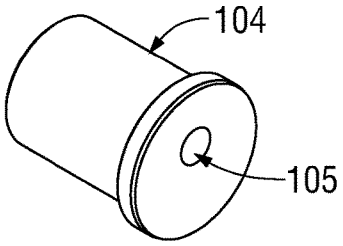
Figure 6A:
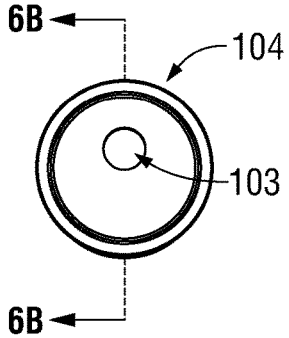
FIGS. 6A, 6B and 6C depict the top valve plate and bottom valve plate in a state of alignment.
Figure 6B:
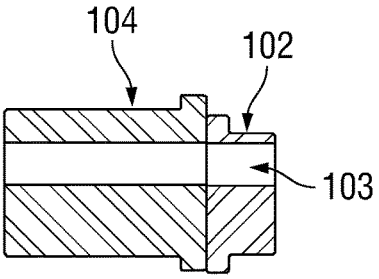
Figure 6C:
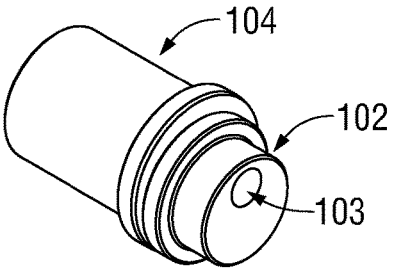

FIGS. 4A, 4B, and 4C and FIGS. 5A, 5B, and 5C depict a prior art valve plate design with a circular hole as the orifice 103—both the top valve plate 102 and the bottom valve plate 104. The top valve plate orifice 103 in top valve plate 102 visible in FIG. 4A and bottom valve plate orifice 105 in FIG. 4B are positioned such that they rotate into and out of alignment as the top valve plate 102 rotates, permitting fluid to pass through when the rotational period brings top valve plate orifice 103 and bottom valve plate orifice 105 into alignment and stops the fluid from passing through when the orifices in the valve plates move out of alignment, with this rhythmic motion resulting in fluid pulses that result in axial shocks. FIG. 6B and FIG. 6C depicts the top valve plate 102 and bottom valve plate 104 in a state of alignment. FIG. 6A depicts the downhole end view of bottom valve plate 104 with top valve plate 102 abutting it but not visible. FIG. 6C depicts the top valve plate 102 and bottom valve plate 104 abutting each other in isometric view. FIG. 6B shows section view U-U as taken from FIG. 6A, with the top valve plate orifice 103 and bottom valve plate orifice 105 in alignment, in which position maximum throughflow is enabled. However, throughflow is limited in this straight, circular orifice design. These valve plates produce a symmetrical pulse wave of limited amplitude and length (duration) due to limited TFA.

Figure 7:
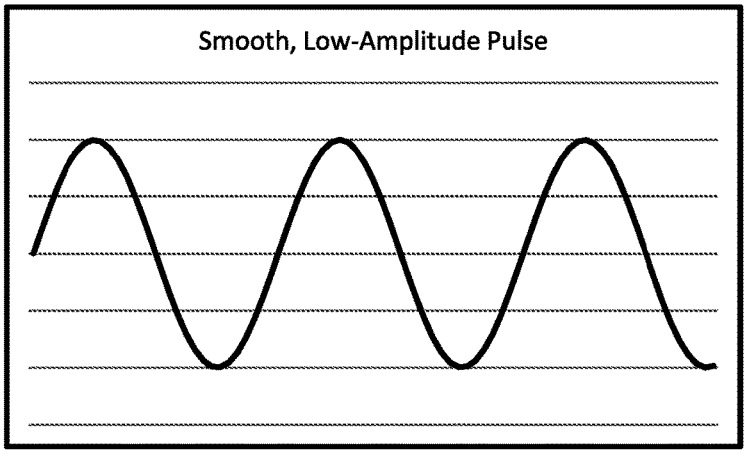
FIG. 7 depicts the low amplitude pulse wave generated when the rotational period brings top valve plate orifice and bottom valve plate orifice into alignment.

FIG. 7 depicts the smooth, symmetrical low amplitude pulse wave that is generated when the rotational period brings top valve plate orifice 103 and bottom valve plate orifice 105 into alignment, as seen in FIG. 6B, and stops the fluid from passing through when the orifices in the valve plates move out of alignment. The limited TFA of top valve plate 102 and bottom valve plate 104 directly correlates with this pulse wave's low amplitude.

Second Case: Shape Profile Pulse

Figure 8A:
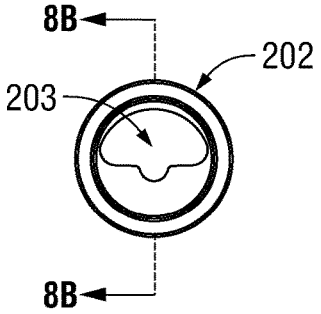
FIGS. 8A and 8B and FIGS. 9A, 9B, and 9C depict isometric views of prior art top and bottom valve plates utilized in the industry.
Figure 8B:
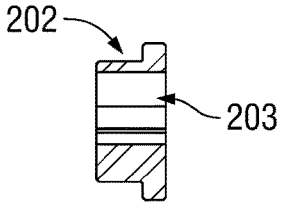
Figure 9A:
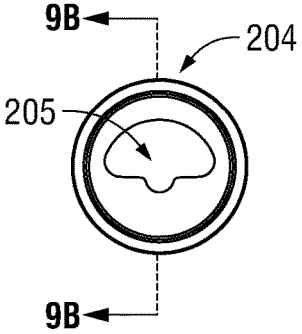
Figure 9B:
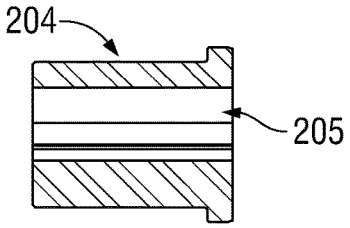
Figure 9C:
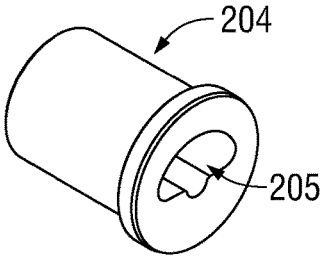

FIGS. 8A and 8B and FIGS. 9A, 9B, and 9C depict section and isometric views of prior art top and bottom valve plates utilized in the industry. FIG. 8A depicts the top valve plate 202 as viewed from its top face, i.e. the end proximal to the rotor outlet seen in FIG. 3A. FIG. 9A depicts the bottom valve plate 204 as viewed from its bottom face. This valve plate design is comprised of a semicircular, i.e. half circular or hemispherical, top valve plate orifice 203 profile and bottom valve plate orifice 205 profile with rounded corners and a straight side bisected by a small semicircle, with the small semicircle overlapping the axial center of both top valve plate 8A and bottom valve plate 9A. The key advantage of this type of valve plate orifice profile is that it provides a greater total flow area than prior art versions with plain round holes, as seen in FIG. 4A and FIG. 5A above. This profile has an orifice that covers a larger area from top face to bottom face of the valve plates than is possible with a circular hole placed within half of the visible plate faces. An additional and important advantage of this type of valve plate over the straight circular orifice seen in FIG. 4A and FIG. 5A is that this valve permits continuous flow-both the rotating top valve plate 202 and the stationary bottom valve plate 204 due to a portion of both orifices being axially centered and overlapping the center portion of each plate. Constant flow through the valve plate orifices controls the severity of the shock as the rotational period alternates valve plate alignment between minimal to maximal flow.

Figure 10A:
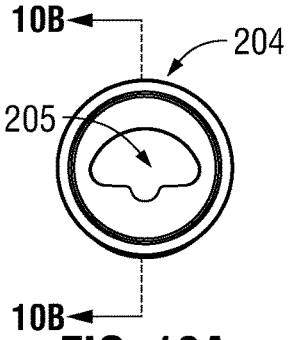
FIG. 10A, 10B, and FIG. 10C depict the top valve plate, side valve plate, and bottom valve plate in a state of complete alignment.
Figure 10B:
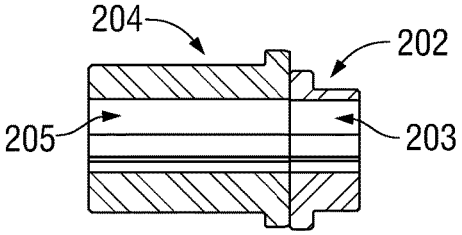
Figure 10C:
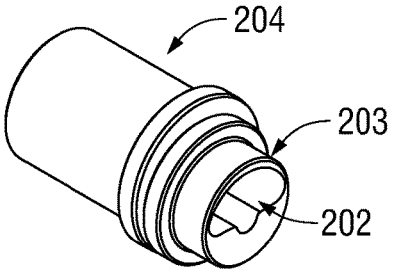

FIG. 10B and FIG. 10C depict the top valve plate 202 and bottom valve plate 204 in a state of complete alignment. FIG. 10A depicts the downhole end view of bottom valve plate 204 with top valve plate 202 abutting it but not visible. FIG. 10C depicts the top valve plate 202 and bottom valve plate 204 abutting each other in isometric view. FIG. 10B shows section view U-U as taken from FIG. 10A, with the top valve plate orifice 203 and bottom valve plate orifice 205 in alignment, in which position maximum throughflow is enabled. Throughflow is clearly increase in this orifice design compared to the plain circular hole orifices seen in FIG. 4A and FIG. 5A above. These valve plates produce a symmetrical pulse wave of greater amplitude and length (duration) due to increased TFA. Additionally, a sudden increase in pressure within the tool for any reason, foreseen or unforeseen, can be accommodated better as the instant valve plates provide pressure relief with the constant axial throughflow.

Third Case: Smooth, High-Amplitude Pulse

Figure 11A:
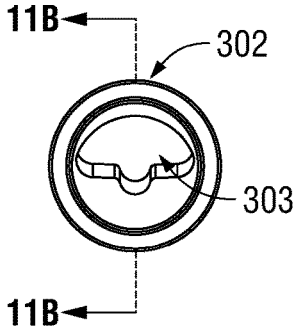
FIGS. 11A, 11B, and 11C depict a top valve plate.
Figure 11B:
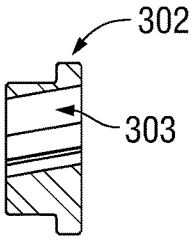
Figure 11C:
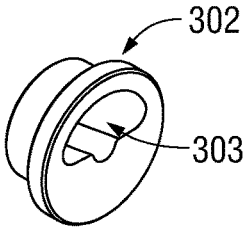
Figure 12A:
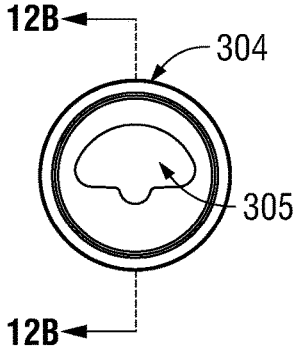
FIGS. 12A, 12B, and 12C illustrate a bottom valve plate.
Figure 12B:
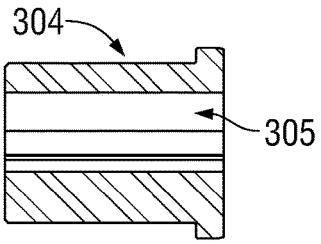
Figure 12C:
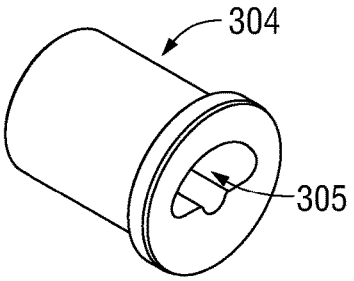

Referring to FIGS. 11A, 11B and 11C, shown in isometric view is a top valve plate 302 resembling top valve plate 202 in FIG. 8A. The top face seen in top valve plate 302 exhibits a semicircular, i.e. half circular or hemispherical, valve plate orifice profile with rounded corners and a straight side bisected by a small semicircle, with the small semicircle overlapping the axial center. Similar to top valve plate orifice 303 profile, a matching bottom valve plate orifice 305 profile depicted in FIG. 12B, where the bottom, downhole end of the bottom valve plate 304 is depicted in isometric view. The overlapping centrally located axial orifices of each valve plate allow for constant throughflow with the advantage of controlling the severity of the shock as the rotational period brings valve plate orifice alignment from minimal to maximal flow, never stopping the flow entirely. Turning to the section view N-N, taken from FIG. 11A, the top valve plate orifice 303 in top valve plate 302 is revealed to be angled. From the top face of the top valve plate 302, the orifice slope runs radially outward, angling outward from the perimeter of the orifice at the face plane so that, viewing left to right in FIG. 11B, the orifice begins at a point radially proximal to the axial center of the valve plate and terminates at a point that is more radially proximal to the outer diameter of the valve plate at its bottom face. That is to say, the orifice slopes outward from top to bottom. This top valve plate orifice 303 with its sloping wall has the effect of increasing the efficiency of flow through the top valve plate 302. Referring back to the helical flow path described in FIG. 2 above, this angled orifice reduces turbulent and shear conditions for fluid flow, accommodating an expanded helical and laminar flow that exits the uphole adjacent rotor 10 and stator 12. The helically rotating fluid is expanding its path outward, radially, from the central bore of the rotor outlet shown in FIG. 3, and this top valve plate 302 accommodates, or conforms to, that flow path, reducing friction and turbulence and allowing the fluid to pass more smoothly through the top valve plate. With the orifice angling outward, it accommodates and conforms to an outwardly expanding helical flow path. The result is that the flow rate is increased in this top valve plate 302 when compared with the top valve plate 202 in FIG. 8A. This is to say that the top valve plate orifice 303 provides a more powerful axial fluid pulse without an increase in pressure in fluid pumped from the surface. The end result is that this orifice results in increased pulse wave amplitude as plate alignment goes from minimal to maximal flow during plate rotation, causing a greater axial shock and increased ROP for the drillstring or BHA. This occurs even with the bottom valve plate 304 in FIGS. 12A, 12B, and 12C having a straight, non-angled axial bore. The net result, in practical terms, is that this top valve plate 302 provides a competitive advantage over prior art systems: when an operator's pumping capacity is at its maximum, which is a common occurrence in striving for ROP, greater shock and resultant ROP is delivered with an angled orifice than with a straight orifice.

Figure 13A:
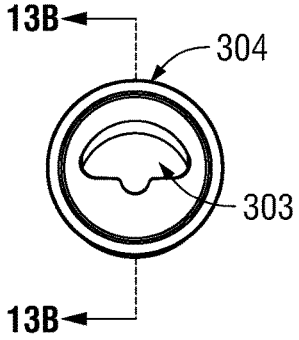
FIGS. 13A, 13B, and 13C depict a top valve plate and bottom valve plate in a state of alignment.
Figure 13B:
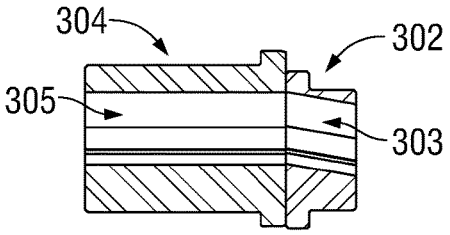
Figure 13C:
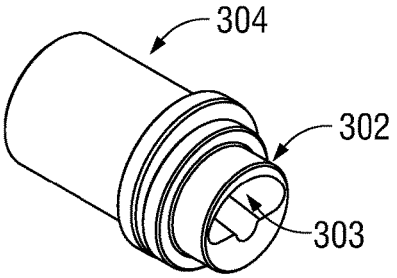

FIGS. 13A, 13B, and 13C depict top valve plate 302 and bottom valve plate 304 in a state of alignment, with both top valve plate orifice 303 and bottom valve plate orifice 305 aligned to provide for maximum throughflow.

Figure 14:
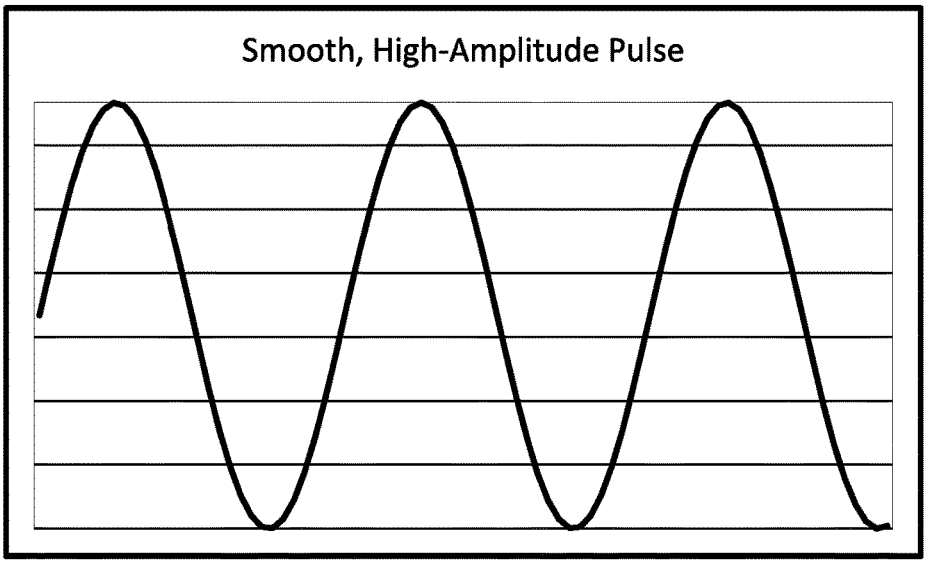
FIG. 14 depicts a high amplitude fluid pulse wave.

FIG. 14 depicts the fluid pulse wave generated as top valve plate orifice 303 and bottom valve plate orifice 305 pass into and out of alignment during rotation. This wave has a higher amplitude than the wave in FIG. 11 as a result of top valve plate orifice 303 angling outward and accommodating the outwardly expanding helical flow passing through rotor outlet 6 seen in FIG. 3A above.

Fourth Case: Slow Rise to Crest, Rapid Fall to Trough Pulse

Figure 15A:
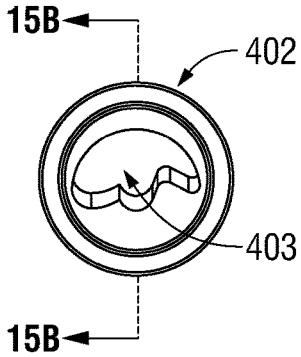
FIGS. 15A, 15B, and 15C and FIGS. 16A, 16B, and 16C depict a top valve plate and bottom valve plate.
Figure 15B:
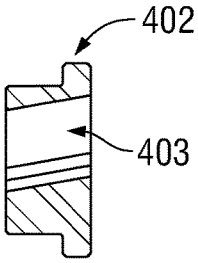
Figure 15C:
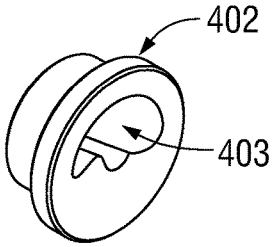
Figure 16A:
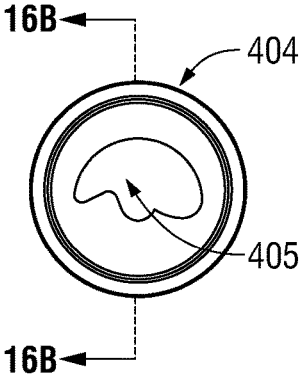
Figure 16B:
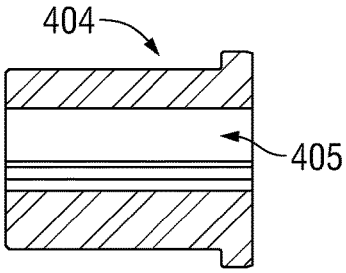
Figure 16C:
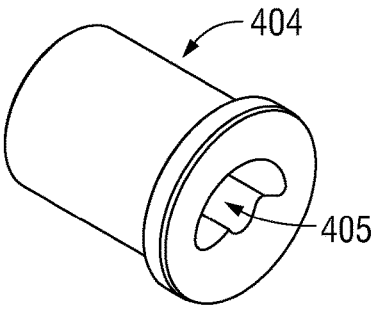
Figure 17:
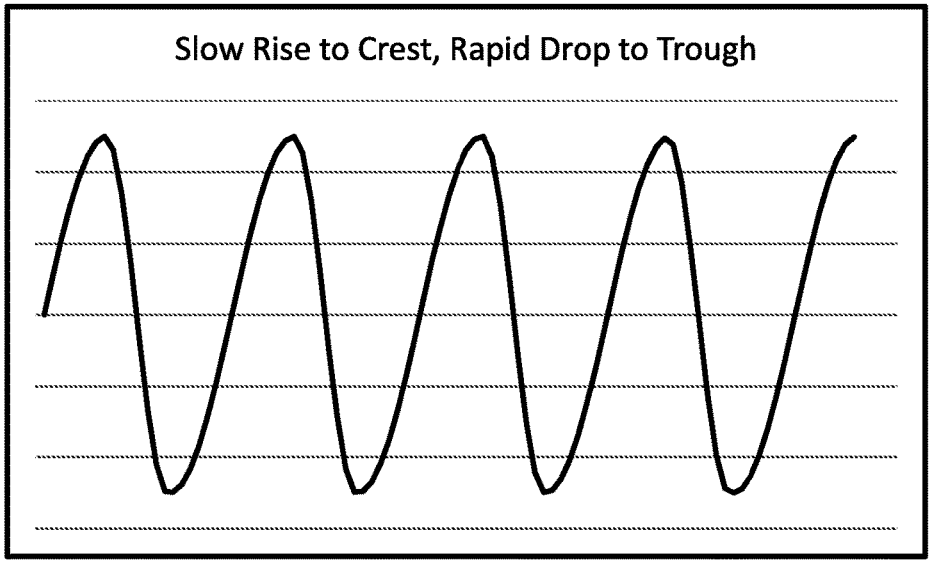
FIG. 17 depicts a slowly rising, rapidly dropping fluid pulse wave.

FIGS. 15A, 15B, and 15C and FIGS. 16A, 16B, and 16C depict top valve plate 402 and bottom valve plate 404. The top valve plate 402 has an irregular, crescent-shaped top valve plate orifice 403 at the top valve plate's top face, with a narrower, tapered leading edge expanding to a broader, wider trailing edge. FIGS. 16A, 16B, and 16C show the accompanying bottom valve plate orifice 405, which matches the shape of top valve plate orifice 403, but does not match its angle. Comparing shapes, not angles, this top valve plate orifice 403 profile of FIG. 15A is the inverse of the top valve plate profile in FIG. 18A below, and this bottom valve plate is the inverse of the FIG. 19A profile. This top valve plate orifice 403 profile combined with bottom valve plate orifice 405 produce a slow pulse spike to crest with a rapid taper to trough, correlated directly with the orifice profile. As the valve plate orifices enter into alignment during the rotational period, the TFA grows slowly to a high crest that tapers quickly to trough, as depicted in FIG. 17. The top valve plate orifice 403 in FIGS. 15A, 15B, and 15C is angled in the same manner as top valve plate 302 in FIGS. 11A, 11B, and 11C, with this angled orifice in FIGS. 15A, 15B, and 15C providing a more powerful axial fluid pulse, again, importantly, without an increase in pressure in fluid pumped from the surface. With the orifice angling outward, it accommodates and conforms to an outwardly expanding helical flow path. The result is that throughflow is increased similar to the valve plates in FIGS. 13A, 13B, and 13C above without the need to increase surface pump pressure. This occurs even though the bottom valve plate orifice 405 is not angled from the axial plane, but straight, unlike the sloping top valve plate orifice 403. However, the asymmetrical valve plate orifices cause the increase and decrease in TFA to be asymmetrical. Therefore, the resulting waveform is not symmetrical.

FIG. 17 depicts the fluid pulse wave generated as top valve plate orifice 403 and bottom valve plate orifice 405 pass into and out of alignment during rotation. This wave has a higher amplitude than the wave in FIG. 11 as a result of top valve plate orifice 403 angling outward and accommodating the outwardly expanding helical flow passing through rotor outlet 6 seen in FIG. 3A above. This wave, as shown, spikes slowly to its crest and then drops rapidly to trough as a result of the asymmetrical TFA increase and decrease in TFA produced by the irregular shapes of the valve plate orifices.

Fifth Case: Rapid Spike to Crest, Slow Drop to Trough Pulse

Figure 18A:
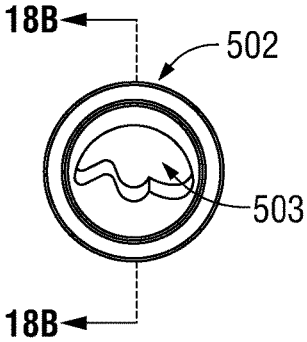
FIGS. 18A, 18B, and 18C depict a top valve plate.
Figure 18B:
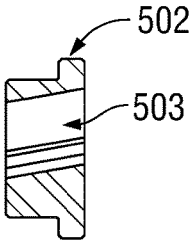
Figure 18C:
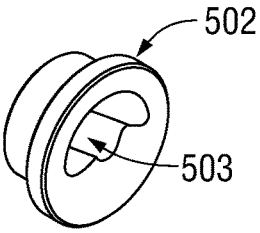
Figure 19A:
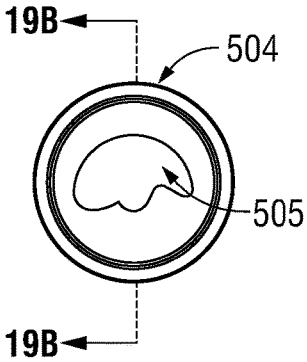
FIGS. 19A, 19B, and 19C depict a bottom valve plate.
Figure 19B:
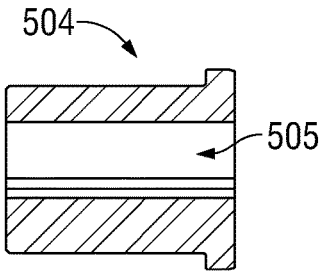
Figure 19C:
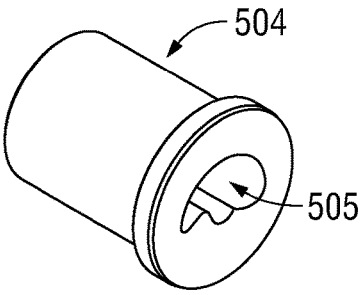

FIGS. 18A, 18B, and 18C depicts a top valve plate 502 and FIGS. 19A, 19B, and 19C depicts a bottom valve plate 504. The top valve plate 502 has an irregular, crescent-shaped top valve plate orifice 503 at the top valve plate's top face, with a broader, wider leading edge tapering to a narrower trailing edge. Examining shapes, this top valve plate orifice 503 has a shape that is the mirror image, or inverse, of 403 in FIGS. 15A, 15B, and 15C, and this bottom valve plate orifice 505 is the mirror image, or inverse, of 405 in FIGS. 16A, 16B, and 16C. This top valve plate orifice 503 in FIGS. 18A, 18B, and 18C when combined with bottom valve plate orifice 505 produces a wave with rapid pulse spike to crest with a slow taper to trough. The rapid spike to crest and slow taper to trough correlate directly with the orifice profiles. During the rotational period, the irregular shapes produce an asymmetrical change in TFA, with a slow increase in TFA initially followed by a rapid decrease. Similarly to top valve plate orifice 403 in FIGS. 15A, 15B, and 15C, this top valve plate 502 has a top valve plate orifice 503 that angles outward. As with 403, top valve plate orifice 503 is angled outward in order to conform to an outwardly expanding helical flow path. The result is that throughflow is increased, similar to the top valve plate orifice 403 in FIGS. 15A, 15B, and 15C above, without the need to increase surface pump pressure. This occurs even though the bottom valve plate orifice 505 is not angled from the axial plane, but straight, unlike the sloping top valve plate orifice 503. Again, however, the asymmetrical valve plate orifices cause the increase and decrease in TFA 10 be asymmetrical. Therefore, the resulting waveform is not symmetrical.

Figure 20:
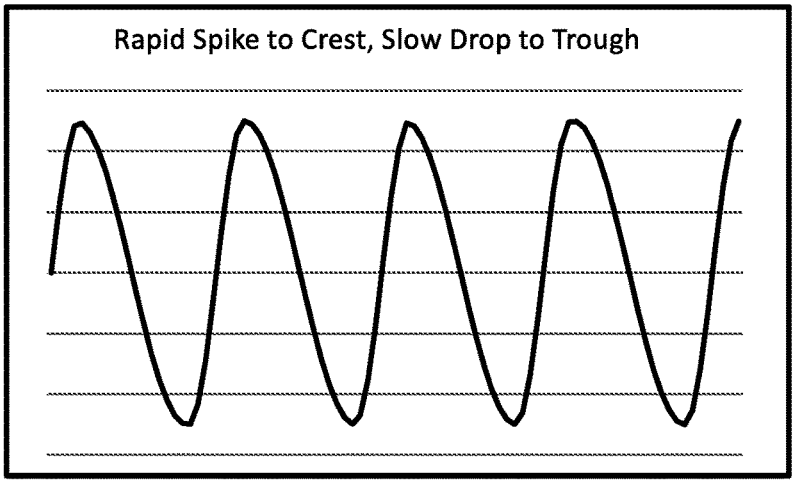
FIG. 20 depicts a rapidly rising, slowly dropping fluid pulse wave.

FIG. 20 depicts the fluid pulse wave generated as top valve plate orifice 503 and bottom valve plate orifice 505 pass into and out of alignment during rotation. This wave has a higher amplitude than the wave in FIG. 11 above. This is a result of top valve plate orifice 503 angling outward and accommodating the outwardly expanding helical flow passing through rotor outlet 6 seen in FIG. 3A above. This wave, as shown, spikes rapidly to its crest and then drops slowly to trough as a result of the asymmetrical TFA increase and decrease in TFA produced by the irregular shapes of the valve plate orifices.

Sixth Case: Smooth, High Amplitude, Crest to Crest Pulse

Figure 21A:
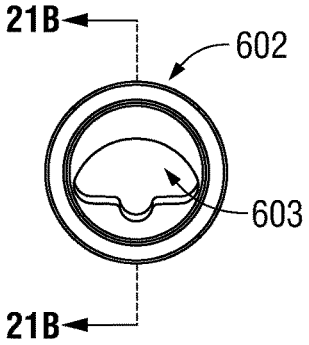
FIGS. 21A, 21B, and 21C depict a top valve plate.
Figure 21B:
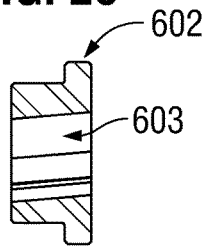
Figure 21C:
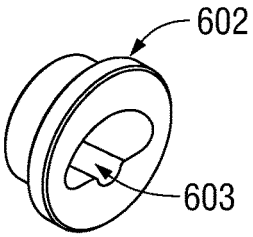
Figure 22A:
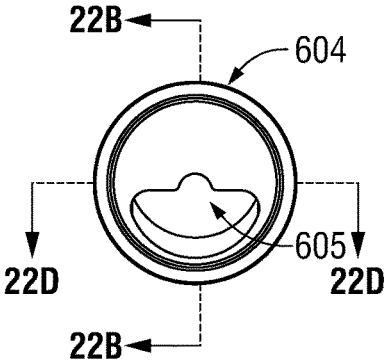
FIGS. 22A, 22B, 22C, and 22D illustrate a bottom valve plate.
Figure 22B:
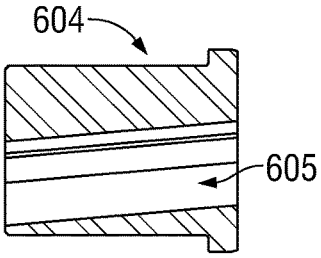
Figure 22C:
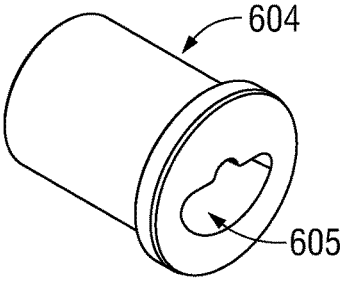
Figure 22D:
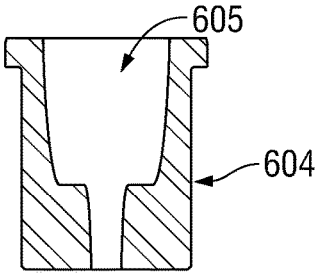
Figure 23A:
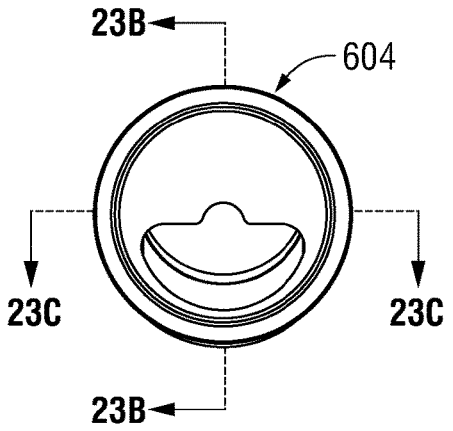
FIGS. 23A, 23B, 23C, 23D, and 23E illustrate a top valve plate and a bottom valve plate.
Figure 23B:
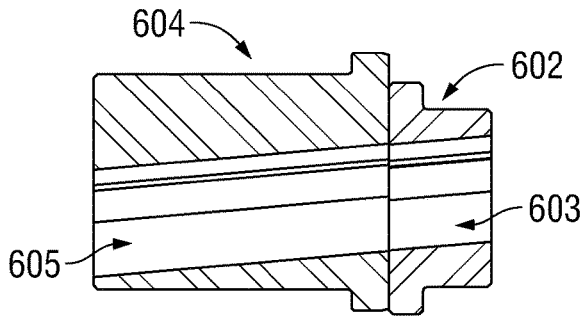
Figure 23C:
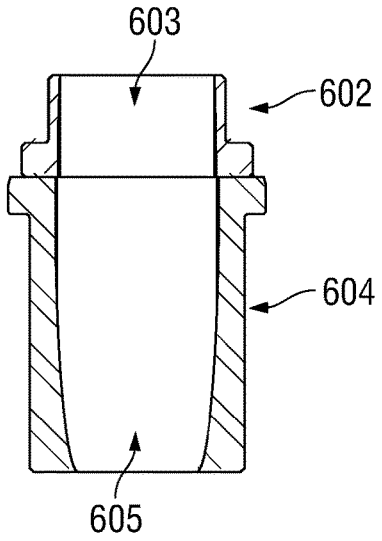
Figure 23D:
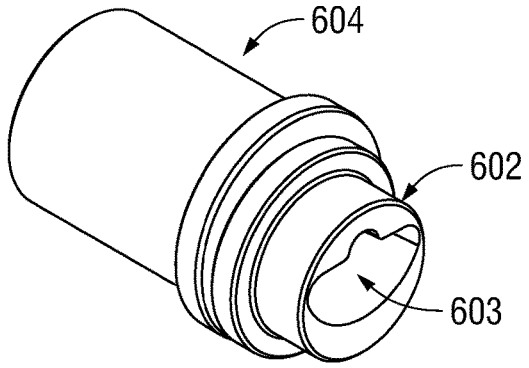
Figure 23E:
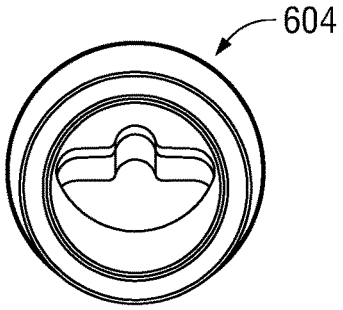

FIGS. 21A, 21B, and 21C depicts a top valve plate 602 with the same profile and slope as the top valve plate 502 in FIGS. 18A, 18B, and 18C. However, contrastingly, in FIGS. 22A, 22B, and 22D, the accompanying bottom valve plate 604 slopes at the same angle as the top valve plate 602. When these plates align, forming a symmetrical fluid path, the profiles conform to and accommodate the helical fluid flow to an even greater degree than the combined FIGS. 18A, 18B, and 18C and FIGS. 19A, 19B, and 19C top valve plate 502 and bottom valve plate 504. FIGS. 23A, 23B, and 23E depict the top valve plate 602 and bottom valve plate 604 of FIGS. 21A, 21B, and 21C and FIGS. 22A, 22B, and 22D abutting each other as they would positioned for operation inside the assembly shown in FIG. 1. FIGS. 23A, 23B, and 23E depict the top and bottom valve plates in complete alignment, at the point when TFA throughflow is maximized. FIG. 23B illustrates the alignment of top valve plate orifice 603 and bottom valve plate orifice 605 at the point where they have passed into complete alignment during the rotational period. With these valve plates aligned, flow passes through comparatively smoothly, not forcing the throughflow back to a straight zero degree axial path after exiting the angled top plate as in FIGS. 18A, 18B, and 18C and FIGS. 19A, 19B, and 19C. The embodiment depicted in FIGS. 23A, 23B, and 23E enables flow to continue on an angled path until it exits the bottom valve plate. These tandem angled orifice profiles, top valve plate orifice 603 and bottom valve plate orifice 605 of FIG. 23B result in yet a greater flow rate increase when compared with the alignment of valve plates in FIGS. 18A, 18B, and 18C and FIGS. 19A, 19B, and 19C.

Figure 24:
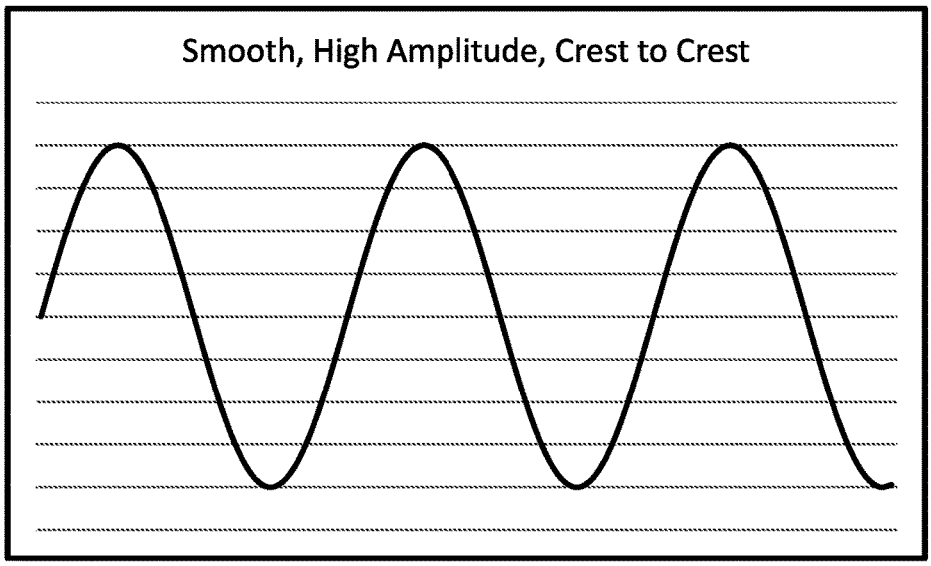
FIG. 24 depicts a more powerful, symmetrical fluid pulse.
Figure 25A:
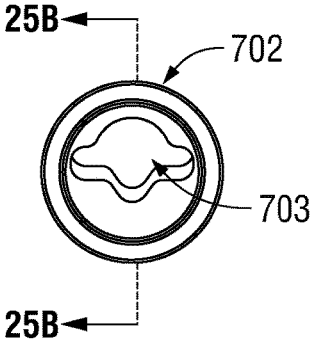
FIGS. 25A, 25B, and 25C depict a top valve plate.
Figure 25B:
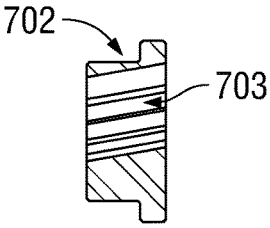
Figure 25C:
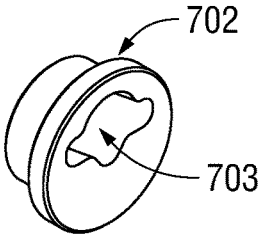
Figure 26A:
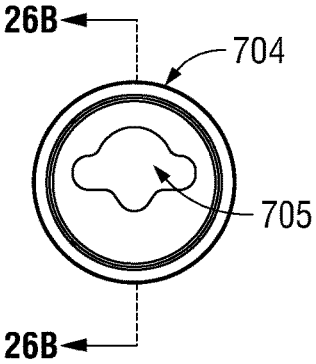
FIGS. 26A, 26B, and 26C depict a bottom valve plate.
Figure 26B:
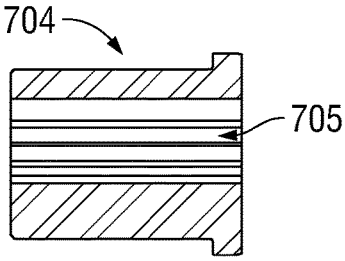
Figure 26C:
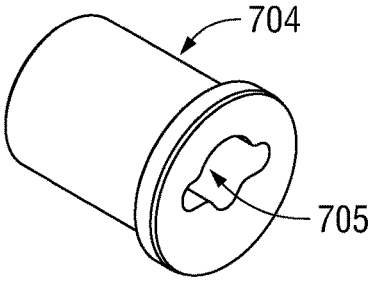

As represented by FIG. 24, a more powerful axial fluid pulse is yielded without an increase in pressure in fluid pumped from the surface. The end result is that this orifice combination results in comparatively greater increased pulse wave amplitude as plate alignment goes from minimal to maximal flow during plate rotation, causing a greater axial shock and increased ROP for the drillstring or BHA.

Seventh Case: Variable Stepped Composite Pulse

FIGS. 25A, 25B, and 25C and FIGS. 26A, 26B, and 26C depict a top valve plate 702 and a bottom valve plate 704, respectively, that produce a composite pulse wave. The composite pulse wave results from non-linear variability in the TFA (total flow area) of the two plates as the top valve plate rotates its top valve plate orifice 703 over bottom valve plate orifice 705 into and out of alignment. Prior to a rotational period that moves the larger TFA orifice areas into alignment, a minimal flow and minimal TFA condition exists due to flow only passing through overlapping semicircular portions of the orifices. Next, at the beginning of the alignment portion of the rotational period, the TFA increases initially, then briefly plateaus its rate of TFA of increase, and next ramps up more rapidly the maximum TFA of the rotational period. After reaching the maximum level of TFA at complete alignment, the pulse wave decreases in a manner that produces a mirror image of the TFA increase. In other words, TFA decreases from the maximum, total-alignment TFA to TFA equaling the first plateaued TFA the initial increase, and then drops to the minimal flow condition that existed with only the overlapping semicircular orifices of the plates permitting throughflow. In sum, the resulting pulse wave rises to a first height, plateaus briefly, rises rapidly to a peak height, decreases rapidly to the same height as the first plateau, and then drops rapidly to trough. The axial shocks generated by this pulse wave occur in a brief, three-level pattern.

Eighth Case: Smooth, Maximum Amplitude, Crest to Crest Pulse

Figure 27A:
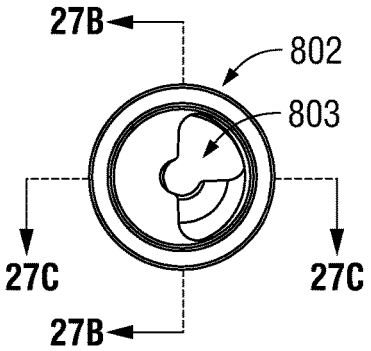
FIGS. 27A, 27B, 27C, and 27D depict a top valve plate.
Figure 27B:
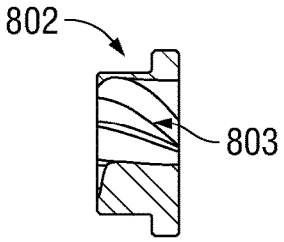
Figure 27C:
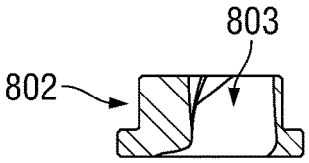
Figure 27D:
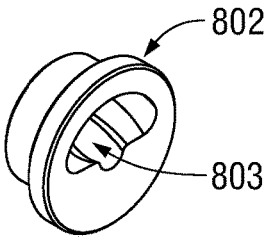
Figure 28A:
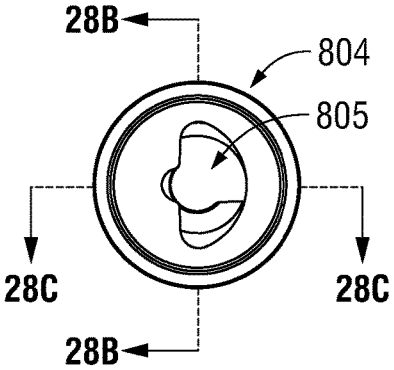
FIGS. 28A, 28B, 28C, and 28D depict a bottom valve plate.
Figure 28B:
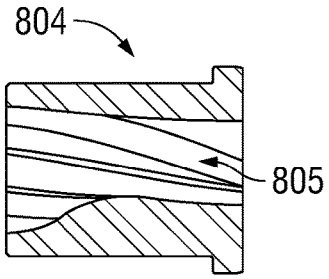
Figure 28C:
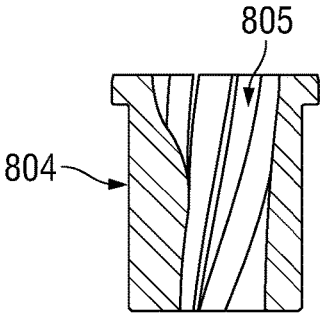
Figure 28D:
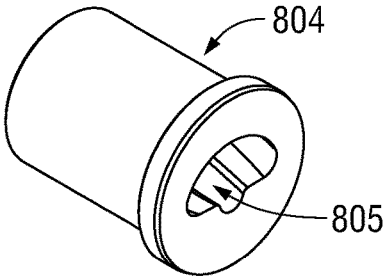

FIGS. 27A, 27B, and 27D and FIGS. 28A, 28B, and 28D depict a top valve plate 802 and a bottom valve plate 804, respectively, that produce a powerful, rapidly rising and falling pulse wave. When these plates align their respective orifices, top valve plate orifice 803 and bottom valve plate orifice 805 at the point where they have passed into complete alignment during the rotational period the profiles conform to and accommodate the helical fluid flow to the greatest extent of any of the valve plate embodiments in this disclosure. The plates' orifice profiles, top to bottom, are helical in form. From a top view of each plate, as seen in FIG. 27A and FIG. 28A, the orifice cavity profile of top valve plate orifice 803 and bottom valve plate orifice 805 takes the form of a vortex, resembling a cavity formed around a twist drill bit, or somewhat like the internal form of a stator, with the profile twisting to the left as formed, top to bottom. This is to say that the circumferential bounds of this twisting profile take the form of a vortex. Additionally, from a top view of each plate, as depicted with top valve plate 802 in FIG. 27A and bottom valve plate 804 in FIG. 28A, the orifice flow path is observed curving about the central axis of each plate. This curving flow path can also be seen in the section views of FIG. 28B and FIG. 28C. Thus the orifices' flow paths, in addition to the outer bounds of the profile cavities, are also helical in nature. Each orifice flow path is positioned such that it extends from the central axial overlapping portion of the orifice to just inside the outer diameter of each valve plate, again, curving leftward as viewed top to bottom in FIG. 27A and FIG. 28A.

Figure 29A:
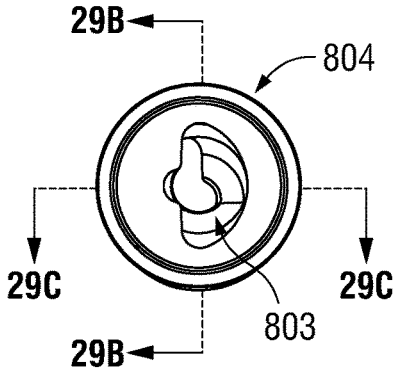
FIGS. 29A, 29B, 29C, 29D and 29E depict valve plates abutting each other as in normal operation.
Figure 29B:
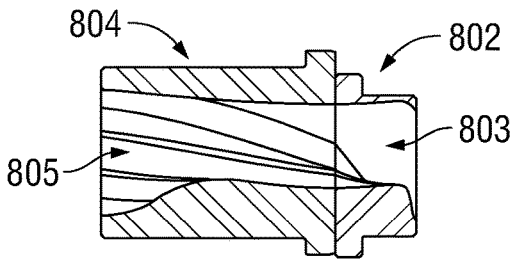
Figure 29C:
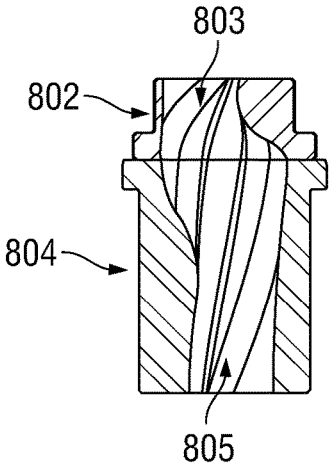
Figure 29D:
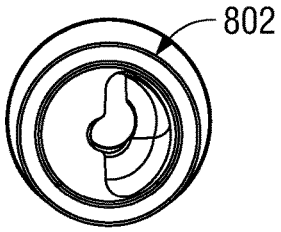
Figure 29E:
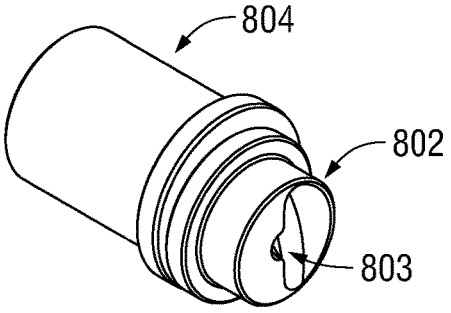

FIGS. 29A, 29B, and 29E depict the valve plates abutting each other as they would during operation as positioned inside the assembly depicted in exploded view in FIG. 1. In FIG. 29B and FIG. 29C, section views again indicate the orifices' curving flow path and also depicts the top valve plate 802 and bottom valve plate 804 in complete alignment, with the symmetrical profiles producing maximal TFA. At the bottom of the top valve plate 802 and top of the bottom valve plate 804, the orifices align at their edges when the rotational period reaches maximum TFA, or complete alignment, of the two plates. As fluid flow exits the rotor outlet 6 depicted in FIG. 3 above, it rotates in a counterclockwise direction and its centripetal force, having passed through the smaller diameter, in comparison to the rotor, of the rotor outlet, causes the flow path to expand outward. The combination of leftward rotating and outwardly moving flow is accepted smoothly by the valve plates in what may be described as harmonic fashion. Shear, turbulence and disruption of flow are minimized as the fluid flow enters and passes through top valve plate orifice 803 and bottom valve plate orifice 805. The valve plate orifices mesh with the flow pattern of the fluid, accepting it and allowing it to pass through most efficiently due to the helical profile of the valve plate orifice cavities as well as the helical flow paths which curve through the body of the valve plates. This helix within a helix permits maximal throughflow when compared with the other valve plates in this disclosure.

Figure 30:
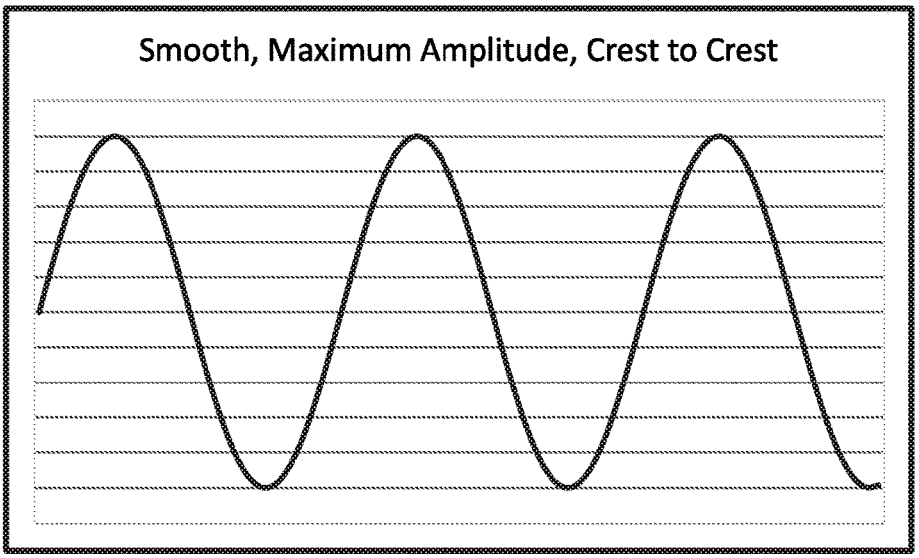
FIG. 30 illustrates the highest-cresting, most powerful fluid pulse in this disclosure.
Figure 31A:
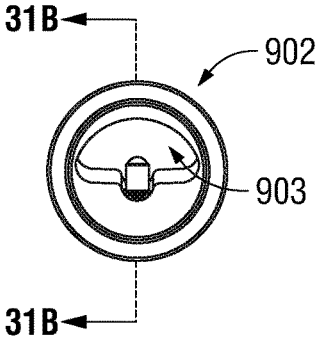
FIGS. 31A, 31B, and 31C depict a top valve plate.
Figure 31B:
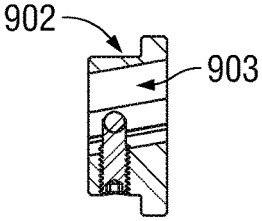
Figure 31C:
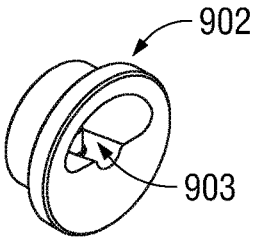
Figure 32A:
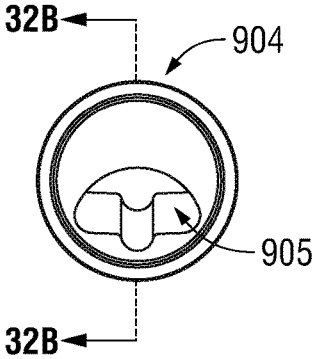
FIGS. 32A, 32B, and 32C depict a bottom valve plate.
Figure 32B:
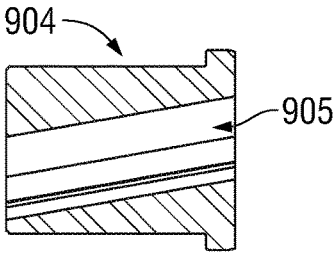
Figure 32C:
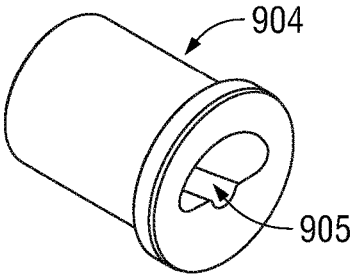

The generated fluid pulse crests higher than the others, with greater amplitude, but in a smooth waveform, as seen in FIG. 30. Similar to top valve plate 802 and bottom valve plate 804 seen in FIGS. 23A, 23B, and 23E, the efficiency of top valve plate orifice 803 and bottom valve plate orifice 805 in FIGS. 27A, 27B, and 27C and 28A, 28B, and 28C, respectively, enables a greater pressure drop and more powerful fluid pulse when compared to the prior art. Most critically, this powerful pulse is generated without increasing pump pressure at the surface. The amplitude of the fluid pulse waves generated by the valve plates in FIGS. 27A, 27B, and 27C and 28A, 28B, and 28C exceeds that of the valve plates depicted in FIGS. 23A, 23B, and 23C above.

Alternative Embodiment: Carbide Screw for Flow-Path Variation

FIGS. 31A, 31B, and 31C and FIGS. 32A, 32B, and 32C depict top valve plate 902 and bottom valve plate 904, respectively. Top valve plate 902 and bottom valve plate 904 have angled orifices, top valve plate orifice 903 and bottom valve plate orifice 905, the same as FIGS. 21A, 21B, and 21C and FIGS. 22A, 22B, and 22C, but with one major difference. As depicted in section view in FIG. 31B, the top valve plate 902 has a threaded hole 909 formed transverse to the outside diameter of the smaller diameter portion of top valve plate 902. A flow restricting bolt 907 is threadably inserted into threaded hole 909. The flow restricting bolt 907 has a rounded end that protrudes into top valve plate orifice 903. The flow restricting bolt 907 may be inserted to a greater or lesser extent into threaded hole 909 by turning it to advance or retract it. The flow restricting bolt 907 alters the throughflow and flow path of fluid passing through top valve plate orifice 903, as well as its TFA. The altered throughflow can be decreased as the flow restricting bolt 907 is advanced, thereby decreasing fluid pulse amplitude. The embodiment in FIGS. 26A, 26;B, and 26C thus makes a directly modifiable pulse that can be changed in the field without the need to swap valve plates. The flow restricting bolt 907 is ideally made of a hard, abrasion resistant material, such as tungsten carbide, in order to resist erosion from particulate matter in the throughflow.

In summary, here is provided a tunable wellbore pulsation valve for reducing drillstring friction in a wellbore that includes an upper valve plate and a lower valve plate, with the upper valve plate housing an upper valve plate orifice enabling throughflow and the lower valve plate housing a lower valve plate orifice enabling throughflow. The upper valve plate associated with a Moineau motor and shouldered against a rotor outlet of the Moineau motor, the upper valve plate rotating during fluid rotation of the Moineau motor, while the lower valve plate remains stationary.

Fluid flow through the drillstring causes a first fluid state of fluid passing through both the upper valve plate and the lower valve plate when the fluid passing causes rotation of the upper valve plate to align the upper valve plate orifice with the lower valve plate orifice, and wherein the fluid flow through the drillstring further causes a second fluid state of fluid not passing through both the upper valve plate and the lower valve plate when the fluid-flow causes rotation of the upper valve plate to not align the upper valve plate orifice with the lower valve plate orifice.

The fluid flow rotationally-alternates the first fluid state and the second fluid state producing fluid pressure pulsations for transmitting axial vibration through the drillstring with the effect of reducing friction experienced by the drillstring against the wellbore wall. The top valve plate orifice comprises rounded corners and a straight side, wherein a semicircle overlaps the axial center of the top valve plate and bisects the straight side. The top valve plate orifice comprises a slope running radially outward from a perimeter of the top valve plate orifice at an upper face-plane the top valve plate, the top valve plate orifice beginning at a point radially proximal to the axial center and terminating at a point radially proximal to an outer diameter of a bottom face-plane of the top valve plate.

The top valve plate orifice slope increases fluid flow efficiency as the fluid flows through the top valve plate orifice by reducing turbulent and shear conditions and increasing laminar, outwardly radial fluid flow conditions for the fluid flowing through the tunable wellbore pulsation valve, where the increased flow efficiency produces more powerful fluid pressure pulsations and axial vibrations without increasing pump pressure at the surface of the wellbore, yielding increased wellbore friction reduction while expending the same or less energy at the surface pump than would be expended in the absence of the reduced turbulent and shear conditions and increased laminar conditions.

Although only a few embodiments have been described in detail above, those of ordinary skill in the art will readily appreciate that many modifications are possible without materially departing from the teachings of this disclosure. Accordingly, such modifications are intended to be included within the scope of this disclosure.

Although the subject apparatuses, methods, and systems here disclosed have been described in detail herein with reference to the illustrative embodiments, it should be understood that the description is by way of example only and is not to be construed in a limiting sense. It is to be further understood, therefore, that numerous changes in the details of the embodiments of this disclosed process and additional embodiments of this method and system will be apparent to, and may be made by, persons of ordinary skill in the art having reference to this description. It is contemplated that all such changes and additional embodiments are within the spirit and true scope of this disclosed method and system as claimed below.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein but is to be accorded the widest scope consistent with the principles and novel features disclosed herein. It is contemplated that additional embodiments are within the spirit and true scope of the disclosed subject matter.

What is claimed is:

1. A tunable wellbore pulsation valve for reducing drillstring friction in a wellbore, said tunable wellbore pulsation valve comprising an upper valve plate and a lower valve plate, wherein said upper valve plate comprises an upper valve plate orifice enabling throughflow and said lower valve plate comprises a lower valve plate orifice enabling throughflow, said upper valve plate associated with a Moineau motor and shouldered against a rotor outlet of said Moineau motor, said upper valve plate rotating during fluid rotation of said Moineau motor, while said lower valve plate remains stationary, wherein said upper valve plate and said lower valve plate are configured for receiving and flowing helical fluid flow progressing centripetally outward from a central axis of said tunable wellbore pulsation valve as said helical fluid flow exits said rotor outlet of said Moineau motor, wherein fluid flow through a drillstring causes a first fluid state of fluid passing through both said upper valve plate and said lower valve plate when said fluid passing causes rotation of said upper valve plate to align said upper valve plate orifice with said lower valve plate orifice, and wherein said fluid flow through said drillstring further causes a second fluid state of fluid not passing through both said upper valve plate and said lower valve plate when said fluid-flow causes rotation of said upper valve plate to not align said upper valve plate orifice with said lower valve plate orifice, wherein said fluid flow rotationally-alternates the first fluid state and the second fluid state producing fluid pressure pulsations for transmitting axial vibration through said drillstring with the effect of reducing friction experienced by said drillstring against the wellbore wall, wherein said upper valve plate orifice comprises rounded corners and a straight side, wherein a semicircle overlaps the axial center of said upper valve plate and bisects said straight side, wherein said upper valve plate comprises an upper face-plane and a bottom face-plane, wherein said upper face-plane indicates a side facing said Moineau motor, and said bottom face-plane indicates a side facing said lower valve plate, wherein said upper valve plate orifice extends from said upper face-plane to said bottom face-plane, wherein said upper valve plate orifice comprises a nominal 2 to 10 degree orifice slope, wherein said orifice slope runs radially outward, angling outward from a perimeter of said upper valve plate orifice at said upper face-plane, wherein said upper valve plate orifice extends at a point radially close to said axial center and terminates close to an outer diameter of said upper valve plate at said bottom face-plane, wherein said upper valve plate orifice at said bottom face-plane aligns symmetrically and conforms with the shape of said lower valve plate orifice, and wherein said orifice slope facilitates in reducing turbulent and shear conditions and increasing laminar, outwardly radial fluid flow conditions for the fluid flowing through said tunable wellbore pulsation valve.

2. The tunable wellbore pulsation valve of claim 1, wherein said upper valve plate and said lower valve plate are associated to produce a low amplitude pulse wave generated when the rotational period brings said upper valve plate orifice and said lower valve plate orifice into alignment.

3. The tunable wellbore pulsation valve of claim 1, wherein said upper valve plate and lower valve plate are associated to produce a smooth, symmetrical low amplitude pulse wave that is generated when the rotational period brings said upper valve plate orifice and said lower valve plate orifice into alignment and, further, stops the fluid from passing through when said upper valve plate orifice and said lower valve plate orifice move out of alignment.

4. The tunable wellbore pulsation valve of claim 1, wherein said upper valve plate and said lower valve plate are associated to produce a smooth, high amplitude pulse wave generated when the rotational period brings said upper valve plate orifice and said lower valve plate orifice into alignment.

5. The tunable wellbore pulsation valve of claim 1, wherein said upper valve plate and said lower valve plate are associated to produce a slow rise to crest followed by a rapid drop to trough pulse wave generated when the rotational period brings said upper valve plate orifice and said lower valve plate orifice into alignment.

6. The tunable wellbore pulsation valve of claim 1, wherein said upper valve plate and said lower valve plate are associated to produce a rapid spike to crest, followed by a slow drop to trough pulse wave generated when the rotational period brings said upper valve plate orifice and said lower valve plate orifice into alignment.

7. The tunable wellbore pulsation valve of claim 1, wherein said upper valve plate and said lower valve plate are associated to produce a first rise to a first high amplitude followed by a second rise to a yet higher amplitude, followed by a first drop to a lower amplitude, to then a second drop to trough pulse wave generated when the rotational period brings said upper valve plate orifice and said lower valve plate orifice into alignment.

8. The tunable wellbore pulsation valve of claim 1, wherein said upper valve plate and said lower valve plate are associated to produce a smooth, maximum amplitude, crest to trough pulse when the rotational period brings said upper valve plate orifice and said lower valve plate orifice into alignment.

9. The tunable wellbore pulsation valve of claim 1, further comprises a carbide screw for permitting flow path variations when the rotational period brings said upper valve plate orifice and said lower valve plate orifice into alignment.

10. A method of operating a tunable wellbore pulsation valve for reducing drillstring friction in a wellbore, the method comprising steps of:

enabling throughflow with an upper valve plate and a lower valve plate, said upper valve plate comprising an upper valve plate orifice and said lower valve plate comprising a lower valve plate orifice;

associating said upper valve plate with a Moineau motor and shouldering against a rotor outlet of said Moineau motor, said upper valve plate rotating during fluid rotation of said Moineau motor, while said lower valve plate remains stationary, said upper valve plate and said lower valve plate configured for receiving and flowing helical fluid flow progressing centripetally outward from a central axis of said tunable wellbore pulsation valve as said helical fluid flow exits said rotor outlet of said Moineau motor;

flowing fluid through a drillstring for causing a first fluid state of fluid passing through both said upper valve plate and said lower valve plate for causing rotation of said upper valve plate to align said upper valve plate orifice with said lower valve plate orifice, and wherein said fluid flow through said drillstring further causes a second fluid state of fluid not passing through both said upper valve plate and said lower valve plate when said fluid-flow causes rotation of said upper valve plate to not align said upper valve plate orifice with said lower valve plate orifice;

rotationally-alternating the fluid flows so that the first fluid state and the second fluid state produce fluid pressure pulsations for transmitting axial vibration through said drillstring with the effect of reducing friction experienced by said drillstring against the wellbore wall;

providing said upper valve plate orifice to comprise rounded corners and a straight side, such that a semicircle overlaps the axial center of said upper valve plate and bisects said straight side;

presenting an upper face-plane and a bottom face-plane at upper valve plate, said upper face-plane indicating a side facing said Moineau motor, and said bottom face-plane indicating a side facing said lower valve plate, extending said upper valve plate orifice from said upper face-plane to said bottom face-plane by providing a nominal 2 to 10 degree orifice slope at said upper valve plate orifice, said orifice slope running radially outward, angling outward from a perimeter of said upper valve plate orifice at said upper face-plane said upper valve plate orifice beginning at a point radially proximal to said axial center and terminating at a point radially close to an outer diameter of said upper valve plate at said bottom face-plane, said upper valve plate orifice aligning symmetrically and conforming with the shape of lower valve plate orifice at said bottom face-plane; and using said orifice slope for reducing turbulent and shear conditions and increasing laminar, outwardly radial fluid flow conditions for the fluid flowing through said tunable wellbore pulsation valve.

11. The method of operating a tunable wellbore pulsation valve of claim 10, further comprising the step of providing said upper valve plate and said lower valve plate to produce a low amplitude pulse wave generated when the rotational period brings said upper valve plate orifice and said lower valve plate orifice into alignment.

12. The method of operating a tunable wellbore pulsation valve of claim 10, further comprising the step of providing said upper valve plate and said lower valve plate to produce a smooth, symmetrical low amplitude pulse wave that is generated when the rotational period brings said upper valve plate orifice and said lower valve plate orifice into alignment and, further, stops the fluid from passing through when the said upper valve plate orifice and said lower valve plate orifice move out of alignment.

13. The method of operating a tunable wellbore pulsation valve of claim 10, further comprising the step of providing said upper valve plate and said lower valve plate to produce a smooth, high amplitude pulse wave generated when the rotational period brings said upper valve plate orifice and said lower valve plate orifice into alignment.

14. The method of operating a tunable wellbore pulsation valve of claim 10, further comprising the step of providing said upper valve plate and said lower valve plate to produce a slow rise to crest followed by a rapid drop to trough pulse wave generated when the rotational period brings said upper valve plate orifice and said lower valve plate orifice into alignment.

15. The method of operating a tunable wellbore pulsation valve of claim 10, further comprising the step of providing said upper valve plate and said lower valve plate to produce a rapid spike to crest, followed by a slow drop to trough pulse wave generated when the rotational period brings said upper valve plate orifice and said lower valve plate orifice into alignment.

16. The method of operating a tunable wellbore pulsation valve of claim 10, further comprising the step of providing said upper valve plate and said lower valve plate to produce a first rise to a first high amplitude followed by a second rise to a yet higher amplitude, followed by a first drop to a lower amplitude, to then a second drop to trough pulse wave generated when the rotational period brings said upper valve plate orifice and said lower valve plate orifice into alignment.

17. The method of operating a tunable wellbore pulsation valve of claim 10, further comprising the step of providing said upper valve plate and said lower valve plate to produce a smooth, maximum amplitude, crest to trough pulse when the rotational period brings said upper valve plate orifice and said lower valve plate orifice into alignment.

18. The method of operating a tunable wellbore pulsation valve of claim 10, further comprising the step of providing a carbide screw for permitting flow path variations when the rotational period brings said upper valve plate orifice and said lower valve plate orifice into alignment.

* * * * *